US011298283B2

(12) United States Patent
Lee

(10) Patent No.: US 11,298,283 B2
(45) Date of Patent: Apr. 12, 2022

(54) BACK THERAPY APPARATUS

(71) Applicant: Chongsu Lee, Edinburgh (GB)

(72) Inventor: Chongsu Lee, Edinburgh (GB)

(73) Assignee: Pacla Medical Limited, Edinburgh (GB)

( * ) Notice: Subject to any disclaimer, the term of this patent is extended or adjusted under 35 U.S.C. 154(b) by 424 days.

(21) Appl. No.: 16/088,205

(22) PCT Filed: Mar. 28, 2017

(86) PCT No.: PCT/GB2017/050870
§ 371 (c)(1),
(2) Date: Sep. 25, 2018

(87) PCT Pub. No.: WO2017/168140
PCT Pub. Date: Oct. 5, 2017

(65) Prior Publication Data

US 2020/0297570 A1 Sep. 24, 2020

(30) Foreign Application Priority Data

Mar. 29, 2016 (GB) ..... 1605197

(51) Int. Cl.
*A61H 1/00* (2006.01)
*A61H 23/00* (2006.01)
*A61H 7/00* (2006.01)

(52) U.S. Cl.
CPC ..... *A61H 1/008* (2013.01); *A61H 7/007* (2013.01); *A61H 2201/0165* (2013.01);
(Continued)

(58) Field of Classification Search
CPC .. A61H 1/008; A61H 7/007; A61H 2230/605; A61H 2201/5051; A61H 2205/081; A61H 2203/0456; A61H 2201/5064; A61H 2201/5056; A61H 2201/1246; A61H 2201/169; A61H 2201/0165; A61H 1/00; A61H 1/0292; A61H 7/00; A61H 7/002; A61H 7/004; A61H 2007/009; A61H 2015/0064;
(Continued)

(56) References Cited

U.S. PATENT DOCUMENTS 1,276,526 A * 8/1918 Hardy ..... A61H 1/008 601/103
1,617,593 A * 2/1927 Hardy ..... 601/97
(Continued)

FOREIGN PATENT DOCUMENTS

| | | | |
|---|---|---|---|
| EP | 1078624 | | 2/2001 |
| JP | H 0975413 A | * | 3/1997 |
| WO | WO2006027277 A1 | | 3/2006 |

*Primary Examiner* — Justine R Yu
*Assistant Examiner* — Christopher E Miller
(74) *Attorney, Agent, or Firm* — Adam Warloick Bell; Matthew Kaser

(57) ABSTRACT

A back therapy apparatus for vertebral massage includes a plurality of manipulating assemblies. The apparatus is adjustable and arranged to engage a spine at multiple locations over an extended length at vertebral areas between a spinous process and a transverse process on either side of a spine. A drive system is adapted to drive multiple manipulating assemblies simultaneously and independently.

14 Claims, 7 Drawing Sheets

(52) U.S. Cl.
CPC ..... *A61H 2201/1246* (2013.01); *A61H 2201/169* (2013.01); *A61H 2201/5051* (2013.01); *A61H 2201/5056* (2013.01); *A61H 2201/5064* (2013.01); *A61H 2203/0456* (2013.01); *A61H 2205/081* (2013.01); *A61H 2230/605* (2013.01)

(58) Field of Classification Search
CPC ..... A61H 39/00; A61H 39/04; A61H 2201/1692; A61H 2201/1695; A61H 2201/0142; A61H 2201/0146; A61H 2201/0149
See application file for complete search history.

(56) References Cited

U.S. PATENT DOCUMENTS 1,978,223 A * 10/1934 Parker ..... 606/239
2,360,975 A * 10/1944 Petersen ..... 601/97
2,664,882 A * 1/1954 Parker ..... A61H 7/007 601/103
2,672,860 A * 3/1954 Badger ..... 601/149
3,113,567 A * 12/1963 Russell ..... A61H 7/004 601/51
4,085,738 A * 4/1978 Kodera ..... A61B 5/00 600/557
4,469,093 A * 9/1984 Chaplar ..... A61H 1/00 601/111
5,092,316 A * 3/1992 Taylor ..... A61H 23/04 601/105
5,101,835 A * 4/1992 DelRe ..... A61B 5/1077 33/512
5,545,177 A * 8/1996 Coseo ..... A61H 39/04 601/107
5,879,312 A * 3/1999 Imoto ..... A61B 5/0053 600/587
6,190,338 B1 * 2/2001 Arndt ..... A61H 1/00 601/102
6,258,047 B1 * 7/2001 Muramatsu ..... A61B 5/103 600/594
6,387,062 B1 * 5/2002 Moore, Jr. ..... A61H 7/007 601/101
6,475,171 B1 * 11/2002 Williams ..... A61H 7/002 601/100
6,669,649 B2 * 12/2003 Kahn ..... A61H 33/6089 600/529
6,681,770 B1 * 1/2004 Dreher ..... A61H 1/008 128/845
7,517,327 B1 * 4/2009 Knight ..... A61H 7/00 601/134
10,675,215 B1 * 6/2020 Yoon ..... A61H 7/001
2003/0158504 A1 * 8/2003 Hiyamizu ..... A61H 1/00 601/99
2003/0212352 A1 * 11/2003 Kahn ..... A61H 35/002 601/98
2004/0002668 A1 * 1/2004 Mahan ..... A61H 7/004 601/86
2004/0158181 A1 * 8/2004 Watanabe ..... A61H 15/0078 601/99
2004/0181258 A1 * 9/2004 Kang ..... A61H 1/008 606/240
2004/0260215 A1 * 12/2004 Kim ..... A61H 15/0078 601/99
2005/0010143 A1 * 1/2005 Kim ..... A61H 15/02 601/99
2005/0222524 A1 * 10/2005 Fielding ..... A61H 23/04 601/98
2007/0167888 A1 * 7/2007 Taylor ..... A61H 7/001 601/103
2007/0173750 A1 * 7/2007 Hudock ..... A61H 15/00 601/128
2008/0243040 A1 * 10/2008 Kuwabara ..... A61H 1/00 601/149
2010/0286569 A1 * 11/2010 Nagano ..... A61H 1/008 600/587
2011/0172573 A1 * 7/2011 Wallace ..... A61H 7/00 601/46
2011/0288586 A1 * 11/2011 Auman ..... A61B 5/1077 606/242
2015/0305959 A1 * 10/2015 Borgman ..... A47C 7/506 601/136
2016/0008211 A1 * 1/2016 Yang ..... A61G 5/125 264/319
2017/0079865 A1 * 3/2017 Kao ..... A61H 1/008

* cited by examiner

BACK THERAPY APPARATUS

FIELD OF THE INVENTION

The present invention belongs to the field of back therapy applied to mitigate the symptoms of Multiple Sclerosis (MS), Parkinson's Disease (PD), back pain and/or back spasticity.

BACKGROUND TO THE INVENTION

Neck and back tension may stem from a range of different issues, such as from an automobile accident or a fall, to simple day-to-day activities, such as sleeping position, one's position while working at a computer, excessive standing and/or excessive sitting. Tension may become chronic and also may be associated with MS, Chronic Fatigue Syndrome, any form of physical or emotional stress, trapped nerve, etc.

Multiple sclerosis is an inflammatory disease in which the insulating covers of nerve cells in the brain and spinal cord are damaged. This damage disrupts the ability of parts of the nervous system to communicate, resulting in a wide range of signs and symptoms, including physical, mental, and sometimes psychiatric problems.

A person with MS can have almost any neurological symptom or sign;

with autonomic, visual, motor, and sensory problems being the most common. The specific symptoms are determined by the locations of the lesions within the nervous system, and may include loss of sensitivity or changes in sensation such as tingling, pins and needles or numbness, muscle weakness, very pronounced reflexes, muscle spasms, muscle spasticity or stiffness, or difficulty in moving; difficulties with coordination and balance (ataxia); problems with speech or swallowing, visual problems (nystagmus, optic neuritis or double vision), feeling tired, acute or chronic pain, and bladder and bowel difficulties, among others. Difficulties thinking and emotional problems such as depression or unstable mood are also common, including suicidal thoughts.

While the cause is not clear, the underlying mechanism is thought to be either destruction by the immune system or failure of the myelin-producing cells. Proposed causes for this include genetics and environmental factors such as infections. MS is usually diagnosed based on the presenting signs and symptoms and the results of supporting medical tests.

There is no known cure for multiple sclerosis. Treatments attempt to improve function. Medications used to treat MS while modestly effective can have adverse effects and be poorly tolerated. Many people pursue alternative treatments, despite a lack of evidence.

There are some devices described in the prior art that allow mobilisation of the spine, for example Parker U.S. Pat. No. 2,664,882, Thornton U.S. Pat. No. 2,660,999, Russell U.S. Pat. No. 3,113,567, Nunes U.S. Pat. No. 3,003,497, Gillaspie and Palmer U.S. Pat. No. 5,074,286.

SUMMARY OF THE INVENTION

According to a first aspect of the present invention there is provided a back-therapy apparatus operable to apply vertebral massage to a person, the apparatus comprising:

a first manipulating element comprising a first engagement member;

a second manipulating element comprising a second engagement member;

wherein the first and second engagement members are arranged such that, in use, they are each situated on opposite sides of the vertebral column;

wherein the first engagement member is operable to contact and manipulate a vertebral area between the spinous and transverse processes from one side of the vertebral column and the second engagement member is operable to contact and manipulate the vertebral area between the spinous and transverse processes from the opposite side of the vertebral column, wherein the first and second manipulating elements are operable independently of each other to move the first and second engagement members respectively into and out of contact with the vertebral area between the spinous and transverse processes thereby manipulating rotational movement of the vertebral column.

Advantageously, an apparatus according to an embodiment of the invention is operable such that pressure can be applied uniformly and simultaneously along a longer band of soft tissue adjacent to the vertebral column compared to a massage given with bare hands. As such, it will be appreciated that the quality of the massage administered by the apparatus according to an embodiment of the invention is improved and improvements in mobility and pain reduction associated with a vertebral massage are expected to be experienced in less massage sessions than conventional hand massage therapy.

Massage of the vertebral area between the spinous and vertebral processes using an apparatus according to an embodiment of the invention minimises twisting effects on the spine and allows consistent pressure to be applied ensuring that therapy along the full length of the spine is possible in one session. As such, the physical requirements to the therapist in each massage session are reduced and therefore a greater number of patients can benefit from the massage in the same day. Using an apparatus according to an embodiment of the invention promotes more uniform and simultaneous application of pressure along the vertebral column in the area adjacent to the spinous and transverse processes of the vertebral column.

The apparatus may further comprise a controller operable to control individual displacement of the first manipulating element independent of the second manipulating element.

Each of the first and second manipulating elements may be operable to facilitate movement of the first and second engagement members from a direction substantially perpendicular to the person's back to a direction that is substantially parallel to the person's back and from a direction that is substantially parallel to the person's back to a direction that is substantially perpendicular to a person's back.

Each of the first and second manipulating elements may be operable to facilitate unidirectional movement of the engagement members into and out of contact with an area between the spinous processes and the transverse processes at an angle between perpendicular and parallel to the person's back, wherein a force is applied in a direction towards the opposite side of the person's vertebral column.

The apparatus may comprise a plurality of first and second manipulating elements and first and second engagement members arranged and distributed in use along the length of the vertebral column, wherein at least the first engagement members can be situated on one side of the vertebral column and at least the second engagement members can be situated on an opposite side of the vertebral column.

The first and second manipulating elements may be arranged in pairs, wherein each first manipulating element is associated with a corresponding second manipulating element.

The apparatus may comprise a plurality of first and second manipulating elements and first and second engagement members, wherein the first manipulating elements facilitate movement of the one or more first engagement members into and out of contact with the area between the spinous or transverse processes separate from movement of a corresponding adjacent one or more second engagement members.

The apparatus may comprise a plurality of first and second manipulating elements and first and second engagement members, wherein the second manipulating element facilitates movement of one or more second engagement members into and out of contact with the area between the spinous processes and the transverse processes separate from movement of a corresponding adjacent one or more first engagement members.

One or more first engagement members may be movable into and out of contact with an area between the spinous and transverse processes simultaneously with one or more non-corresponding, non-adjacent second engagement members, which may be movable into and out of contact with the area between the spinous and transverse processes.

The first manipulating elements may facilitate movement of the one or more first engagement members into and out of contact with the area between the spinous and transverse processes separate from movement of a corresponding adjacent one or more second engagement members.

The first and second manipulating elements may comprise a sensing element operable to sense load and/or displacement of the first and second engagement members when in contact with the area between the spinous and transverse processes; and may be operable to provide feedback of said displacement and/or pressure as an indication of vertebral stiffness or pain.

The first and second manipulating elements may be operable to adjust the first and second engagement member's orientation respectively, such that the apparatus is adaptable to shapes and contours of a person's vertebral anatomy.

The position of the first and second engagement members relative to adjacent and corresponding first and second engagement members and relative to the area between the spinous and transverse processes may be adjustable responsively in contact with the area between the spinous and transverse processes.

The first and second manipulating elements may comprise jointed members.

The first and second manipulating elements may be manufactured from bendable material.

The first and second engagement members may comprise a resilient contact surface.

The first and second manipulating elements may comprise shape memory material.

The first and second engagement members may comprise shape memory material.

The controller may be operable to automate movement of each of the first and second manipulating elements relative to each other and, in use, relative to an area between the spinous and transverse processes on a person's back.

The controller may be operable to control frequency of movement of each of the first and second manipulating elements.

The controller may be operable to control each of the first and second manipulating elements individually or in banks of two or more.

The controller may be operable to monitor and control amplitude of displacement of the first and second engagement members.

The controller may be operable to sense or measure displacement from each of the first and second manipulating elements and/or first and second engagement members thereby being operable to identify stiffness in a person's vertebral column.

The controller may be operable to control and/or program a sequence of movements of the first and second manipulating elements.

The first and second manipulating elements may emulate fingers and the first and second engagement members may emulate fingertips.

The apparatus may further comprise a load and/or position sensor operable to sense load and/or position of soft tissue in the area between the spinous and transverse processes.

A further aspect of the present invention provides a massage table incorporating the apparatus of the first aspect.

Alternative embodiments of the present invention may provide an apparatus comprising one or more members defining an elongate area.

The/each member of the apparatus may apply force in only one direction. That means that some of the members apply force partially from left to right only and others partially from right to left only and in all of them the/each member can apply a force partially towards the base of the area between the spinous and transverse process.

The/each elongate area may be longer than a hand span. In at least one embodiment of the present invention an apparatus that applies a force simultaneously over a length longer than a hand span is more effective than the therapist hands for applying a massage, since it allows to apply forces simultaneously over longer distances on the back, which may be of additional benefit.

The apparatus may comprise two members defining two parallel elongate areas. Alternatively, the apparatus may comprise a plurality of members defining two parallel elongate areas.

In some embodiments, where there are two parallel elongate areas, one or more members may define an area and may be adapted to apply force and the other members may define a parallel area and act as a support only.

In other embodiments, both members or both sets of members defining parallel elongate areas may be adapted to apply force.

Other embodiments may comprise only one member or one set of members defining one elongate area, the elongate area being adapted to apply a force.

The/each elongated area may be a narrow area. For example, the/each elongated area may have a width of about three fingers (5-6 cm). Alternatively, the/each elongated area may have a width of about two fingers (3-4 cm). Alternatively, the each/elongated area may have a width of about 2 cm or less.

The/each member may be padded. In at least one embodiment of the present invention when the apparatus comprises one or more padded members, the applied force is dampened in those points where the back is stiffer, thereby preventing over-pressing in those points and preventing bruising or other undesirable consequences.

The/each member may be adapted to define an ergonomic profile. In at least one embodiment of the present invention an apparatus where the member(s) defines an ergonomic profile is more suitable for applying forces to the back without creating excessive pressure or tension at some points in the back, thus preventing lesions, bruising and other inconveniences.

The/each member may comprise a high friction surface. In at least one embodiment of the present invention a high-friction surface allows application of forces to soft tissue and prevents slipping of the soft tissue from the members.

The high-friction surface may comprise a rubber surface. In at least one embodiment of the present invention a rubber surface is suitable to apply force to the flesh and prevents the flesh slipping to its original position and escape the grip of the rubber surface.

The apparatus may be configured to adjust the/each member orientation for adapting the apparatus to the person's anatomy.

The/each member may be configured to define an adaptable area. The adaptable area may be an area which can be shortened or stretched depending on the person's back size.

The adaptable area may be defined by at least one bendable member. In at least one embodiment of the present invention the at least one bendable member can be bent to reproduce the person's back profile but still preserves enough rigidity for applying forces to the back. This may be achieved with bendable bands of metal.

The adaptable area may be defined by a material with shape memory. In at least one embodiment of the present invention, shape memory materials are used as the adaptable contact materials that allow pressing on the back soft tissue without creating excessive pressure points, bruising and pain when applying the massage.

The adaptable area may be defined by a plurality of finger-shaped elements.

Each finger-shaped element may be individually dampened. In at least one embodiment of the present invention individually dampened finger-shaped elements can apply simultaneous forces to a length of the back adjacent to the area between the spinous and transverse processes in order to loosen the vertebrae joints without creating torsion in the vertebral spine. The dampening prevents over pressing in certain areas of the back, to avoid bruising, tensions or other potential lesions.

The apparatus may be configured to adjust the distance between the finger-shaped elements. In at least one embodiment of the present invention the apparatus with adjustable distance between the finger shaped elements can be configured to apply a massage to persons with different back lengths or separation between spinous processes.

The apparatus may be configured to adjust the distance between the finger-shaped elements automatically. This automatic adjustment enables a quicker adaptation of the apparatus and reduces the preparation time before applying the massage.

The apparatus may be configured to adjust the relative position of the finger-shaped elements. In at least one embodiment of the present invention by adjusting the relative position of the finger-shaped elements it is possible to adapt the apparatus to apply forces simultaneously to a length of flesh adjacent to a deformed or distorted vertebral column.

The adaptable area may be hydraulically dampened. Alternatively, or additionally the adaptable area may be pneumatically dampened. Alternatively, or additionally the adaptable area may be mechanically dampened, for example with springs or elastomers within a piston like mechanism behind the adaptable area.

The apparatus may be configured to apply forces hydraulically, for example with hydraulic pistons.

Alternatively or additionally the apparatus may be configured to apply forces pneumatically, for example with pneumatic pistons.

Alternatively or additionally the apparatus may be configured to apply forces mechanically, for example a force generated by an electrical motor.

Alternatively the apparatus may be configured to apply forces manually.

Where the apparatus is configured to apply forces manually, the apparatus may further comprise at least one gripping portion, for example a handle.

Where the apparatus is configured to apply forces manually, the apparatus may be configured to reduce the force to be applied manually.

In at least one embodiment of the present invention the apparatus may comprise a fulcrum mechanism to augment the forces applied manually.

In other embodiments the apparatus may comprise a geared mechanism for augmenting the forces applied manually.

These mechanisms may reduce the physical requirements on the therapist for applying the massage over a prolonged period of time.

The apparatus may be configured to apply forces to each side of the person's vertebral column, in use. In at least one embodiment of the present invention by an apparatus configured to apply forces to each side of the vertebral column is more suitable to apply equal amount of forces to each side of the vertebral column.

The apparatus may be configured to apply forces alternatively to each side of the person's vertebral column, in use. In at least one embodiment of the present invention applying alternative forces to each side of the vertebral column enhances the loosening effect of the massage on the vertebral column.

Force may be applied to one surface band at one side of the vertebral column and the other parallel band is a support, either fixed or dampened.

The apparatus may comprise a control unit and automated mechanisms for automatically controlling the/each force and/or movements applied by the/each surface. The control unit may be configured to control force, frequency and/or amplitude of the movements. The control unit may also be configured to control and/or program a sequence of movements, for example by defining repetitions, alternations, oscillations, etc.

The apparatus may comprise an electronic interface to allow parameters input to the control unit. In at least one embodiment of the present invention a control unit and an electronic interface greatly facilitates a regular and controlled application of massages.

The control unit may comprise a memory to store information of previous massages and/or persons.

A method for applying a vertebral massage to a person may comprise applying a series of forces to a substantial length of soft tissue located adjacent either side of a person's vertebral column, the series of forces comprising:

at least one or more first forces, the one or more first forces being applied simultaneously to a substantial length of soft tissue located adjacent a plurality of areas between the spinous and transverse processes, parallel to and on a first side of the person's vertebral column, the one or more forces being applied partially towards the base of the area between each spinous and transverse process and partially towards a second side of the person's vertebral column opposite the first side such that a substantial length of the vertebral column is simultaneously rotated in a first direction by the action of said first forces on the plurality of vertebral areas between the spinous or transverse processes; and at least one or more second forces, the one or more second forces being applied simultaneously to a substantial length of soft tissue located adjacent a plurality of spinal or transverse processes, parallel to and on a second side of the person's vertebral column, the one or more forces being applied partially towards the base of a vertebral area between each of the spinous and transverse processes and partially towards a first side of the person's vertebral column opposite the second side such that a substantial length of the vertebral column is simultaneously rotated in a second direction opposite the first direction by the action of said second forces on a plurality of vertebral areas between spinous and transverse processes.

By performing such method on people suffering from MS, many of the symptoms of MS are mitigated, among which the following improvements have been observed:

improved and faster walking;

augmented energy level and general mood improvement;

improved bladder control and function; and pain remission.

Whilst not wishing to be bound by his theory, the inventor submits that the benefits of the present invention arise from the mobilisation, loosening and stiffness reduction of and around the vertebral column.

Neck and/or back tension may be reduced or often eliminated by gentle mobilisation (rotation) of the spine.

The vertebral column comprises thirty-three vertebrae and is divided into four areas; namely, cervical, thoracic, lumbar and sacral. Each vertebra is connected to adjacent vertebrae by the vertebral discs, but each vertebra also comprises several other joints.

It is a common practice for physical therapists, chiropractors, and other practitioners to utilize various manual techniques to mobilize the joints of the spinal column, including the intervertebral joints, the synovial facet joints, the costovertebral joints, and the costotransverse joints. Such joint mobilisation distends the joint capsule ligaments and reflexively relaxes the associated muscles. Synovial fluid, upon mobilization, seeps to areas of the articular cartilage surfaces to provide lubrication for the joints, decreasing pain and providing relief to the person. The synovial fluid is pumped and shifted within the articular capsule of the joint by joint motions including flexion, extension, rotation, and a sliding action of the opposing joint surfaces relative to one another. Furthermore, the purpose of vertebral mobilization is to increase the intradiscal space between the vertebrae to allow for water diffusion and nutrition exchange within the vertebral segment (vertebrae-disc-vertebrae). When this happens, muscle spasms decrease, spinal mobility increases, and pain relief is achieved.

Therapists employ various hands-on techniques and forces to achieve the desired degree of spinal mobilization. There are five grades of mobilization typically used: Grades I and II are small amplitude movements performed at the beginning of range of motion at a given joint. The effect of these movements is to reduce pain by the aforementioned fluid movements. Grade III is a large amplitude motion in the last half of range. This movement is sufficient to increase range of motion as well as decrease pain. Grade IV is a small amplitude motion or a sustained pressure at the very end of range sufficient to stretch the joint at the point of resistance. The result is to increase range of motion to the limit of normal active range. Grade V is a quick movement requiring a pressure fulcrum which produces a movement beyond the person's active range of motion. It is sometimes called "popping" of the joints and is similar to the cracking of one's knuckles. In the spine, such hyperextension is useful to provide an immediate relief of pain and increase of normal active range.

These grades of spinal mobilisation bring pain relief and increase the range of motion. However, it is very hard to bring relief to people whose tension around vertebra is chronic or associated with MS, Chronic Back Pain, Parkinson's Disease, Chronic Fatigue Syndrome, Fibromyalgia, etc.

The inventor has developed and refined a technique that mobilises the spine via subtle, slow and constant movements of the vertebrae, from left to right and right to left, with lesser force than Grade I, when a person lies on a massage table and is relaxed. These gentle and slow movements are delivered continually for at least 30 minutes. This technique has brought help with chronic tension associated with aforementioned problems and also problems such as mobility, balance, neck/back pain, pins/needles/numbness in arms or legs, bladder urgency, stress, accident, sports injuries, and various other problems. Depending on the severity of the tension and which problem is this tension associated with, it takes from a few up to 50+ weekly sessions to significantly relieve the symptoms.

The inventor has observed that mobilising each vertebra, while reducing or minimising torsional movements between vertebrae, which is achieved by applying pressure/forces as described above, the vertebral column is loosened and persons with MS show a surprising and unprecedented remission in MS symptoms after a few weeks of continued treatment sessions. The vertebral column is therefore treated as an elongated solid cylinder and it is alternately, from right to left or left to right, moved sideways, thereby loosening the vertebral joints and soft tissue around them, while minimising torsional movements.

The present back therapy treatment can be applied to any person with back problems but is thought to be particularly suitable and effective for those who present back stiffness due to MS; many MS sufferers suffer from spasticity, which is commonly described as an unusual stiffness in the muscles. The inventor is of the opinion that many of the MS symptoms are caused or aggravated by back spasticity.

Clinically, spasticity is caused by the loss of inhibition of motor neurons, causing excessive muscle contraction. Spasticity mostly occurs in disorders of the central nervous system affecting the upper motor neurons in the form of a lesion, such as spastic diplegia, or upper motor neuron syndrome, and can also be present in various types of multiple sclerosis, where it occurs as a symptom of the progressively-worsening attacks on myelin sheaths and is thus unrelated to the types of spasticity present in neuromuscular cerebral palsy rooted spasticity disorders.

The cause of spasticity is not really known, but there are several theories.

Research has clearly shown that exercise is beneficial for spastic muscles, even though in the very early days of research it was assumed that strength exercise would increase spasticity.

Spasticity is assessed by feeling the resistance of the muscle to passive lengthening in its most relaxed state. A spastic muscle will have immediately noticeable, often quite forceful, increased resistance to passive stretch when moved with speed and/or while attempting to be stretched out, as compared to the non-spastic muscles in the same person's body (if any exist).

Therefore, the present back therapy treatment could be also suitable to improve or mitigate the symptoms of any person with back spasticity or stiffness and/or pain because to and from the spine there are numerous blood vessels and nerves that feed or connect other organs and areas of the body, such that if the spine and its surrounding areas are unusually stiff, this could create a number of symptoms elsewhere in the body and loosening and removing tension from and around the spine could eventually result in improvements in many symptoms which could have been previously thought to be unrelated.

Preferably the series of forces is applied in a sequence such that there is a substantial effect compensation between the forces applied to either side of the vertebral column over a time the method is carried out in a session.

DETAILED DESCRIPTION OF THE DRAWINGS

Figure 1:
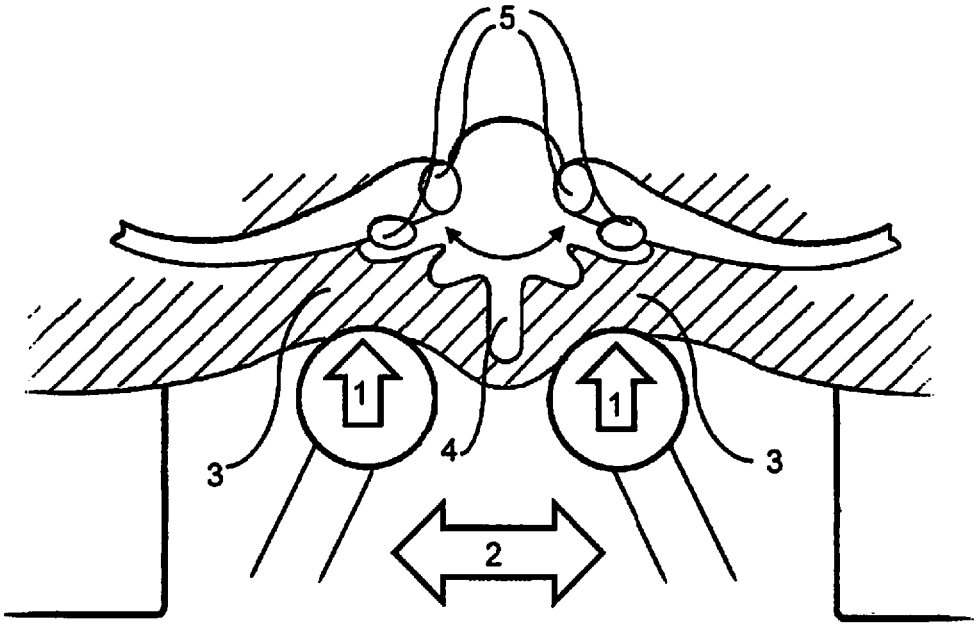
FIG. 1 illustrates the principles underlying the present invention.

Referring to FIG. 1 a method utilising an apparatus according to an embodiment of the present invention is now described. The method comprises the application of one or more forces/pressure, indicated generally by reference numbers 1 and 2, to the soft tissue 3 located adjacent to each side of the vertebral column in the vertebral area between the spinous and transverse processes 4. The one or more forces are applied partially towards the base of the area between the spinous and transverse processes 4 and partially towards a second side of the vertebral column opposite the first side such that a substantial length of vertebral column is simultaneously rotated or rocked by the action of said forces on a plurality of vertebral areas between the spinous and transverse processes 4.

The aim of the method is to create movement of the spine to both sides so that the vertebral junctions 5 loosen up. In order to do that it is important to move the spine as an elongated cylinder, without torsional movements because this facilitates movements of the vertebral joints.

To create movement of the spine towards both sides, it is important to at least partially engage the area of the spine between the spinous and transverse processes, by applying force towards the base of the area from each one of their sides and then create movement by applying forces towards one side first and then towards the opposite side, to compensate the first movement. This requires a substantial amount of force in persons with stiff back problems and sometimes it is desirable to extend the reach of the hand, so that more length of the backbone can be moved at once.

It is also important that the movements are applied uniformly, gradually, firmly and over prolonged periods of time. A suitable frequency of movements lies in the range of about 6 to 10 movements per minute, although other frequency may also impart benefits.

Although a substantial amount of force is required, caution must be exercised not to apply excessive force in local points so as to not cause bruises, pain or excessive discomfort.

Figure 2:
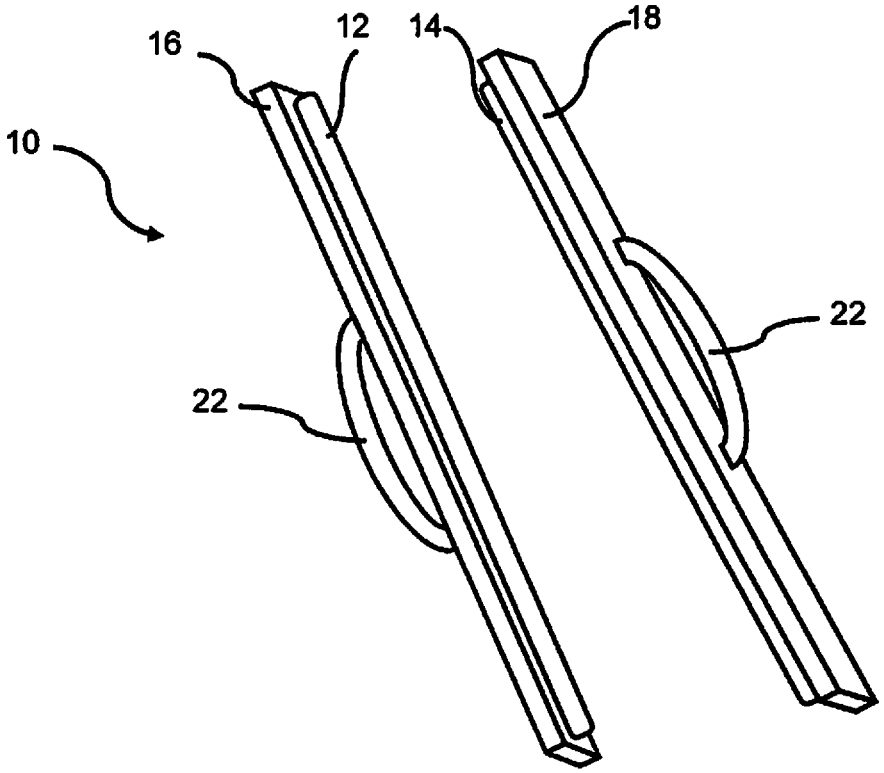
FIGS. 2 to 8 represent different embodiments of the present invention.

Referring now to FIG. 2 an embodiment of the present invention will be described. FIG. 2 shows an apparatus 10 that comprises two elongated narrow surfaces 12, 14. The elongated narrow surfaces 12, 14 are padded with foam surrounded by anti-allergenic artificial leather, for a soft feel and adaptability to the back profile. The surfaces are mounted onto two rigid wooden bars 16, 18. There are two gripping portions on the bars 20, 22 at the opposite sides of the padded surfaces in the shape of handles to facilitate the simultaneous application of force to an elongated area at each side of the vertebral column.

Figure 3:
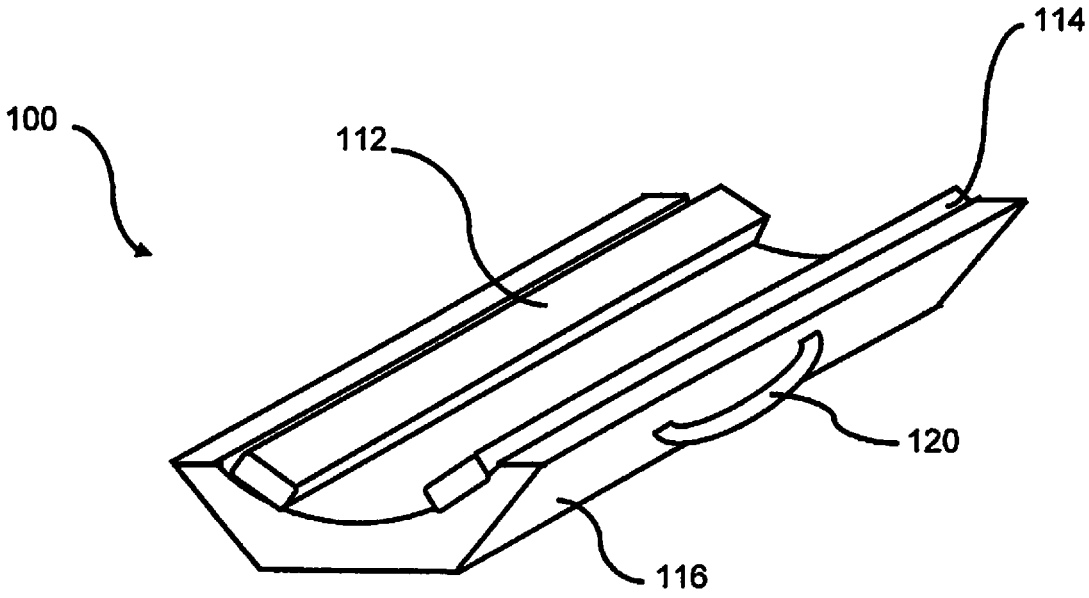

FIG. 3 shows another embodiment 100 of the present invention. In this embodiment, the padded elongated surfaces 112, 114 are mounted parallel to each other onto a rigid support 116. The support 116 comprises handles 120 to facilitate manual application of force onto the sides of the backbone.

Figure 4:
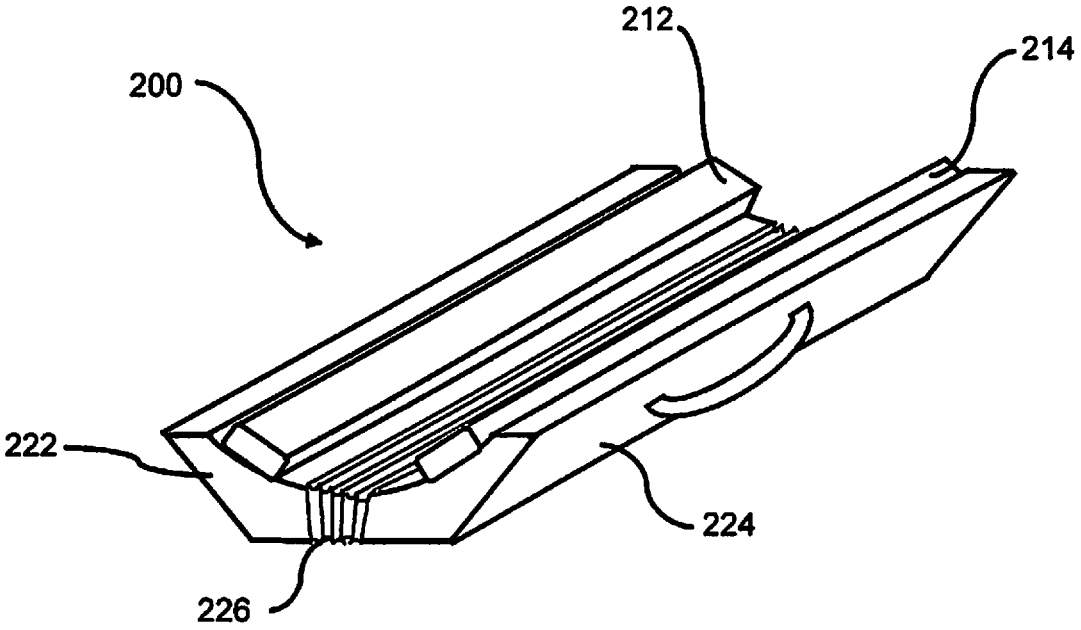

FIG. 4 shows another embodiment 200 of the present invention, similar to that shown in FIG. 3, with the additional feature that the support is divided in two sections 222, 224 which are connected with an extendable and compressible portion 226, such as a bellows. The bellows, 226 allows independent application of force with each padded surface 212, 214 onto each side of the vertebral column, so that, for example, force may be applied to one side of the column, while the apparatus may be also used to provide support to the opposite side of the vertebral column simultaneously.

Figure 5:
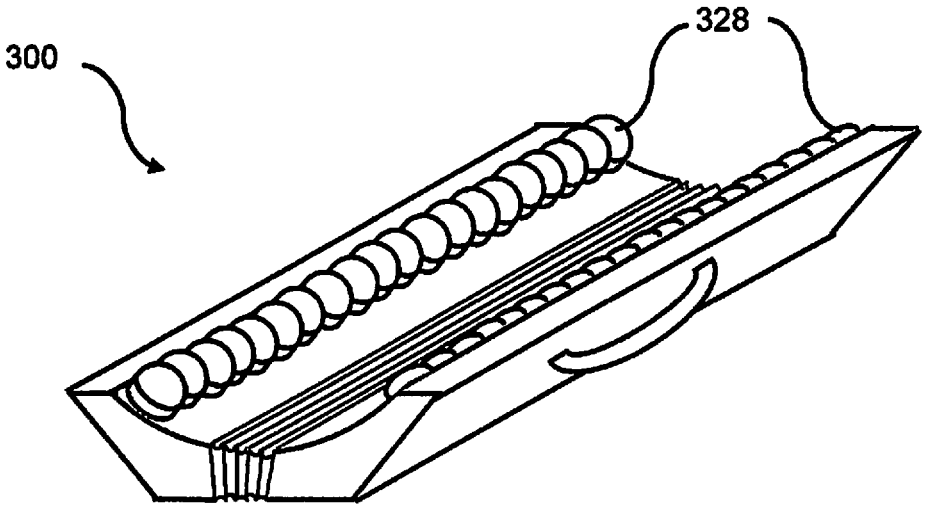

FIG. 5 shows another embodiment 300 of the present invention, similar to that shown in FIG. 4, with the additional feature that the elongated surfaces are divided into a plurality of padded buds 328. There are twenty buds 328 on each side of the apparatus 300. By having a plurality of individually padded buds 328 or surfaces that define an elongated area it is possible to apply simultaneously a force to an elongated portion at each side of the vertebral column while avoiding applying excessive force or pressure to local points so as to reduce the possibility of creating bruises, pain or excessive discomfort.

Figure 6:
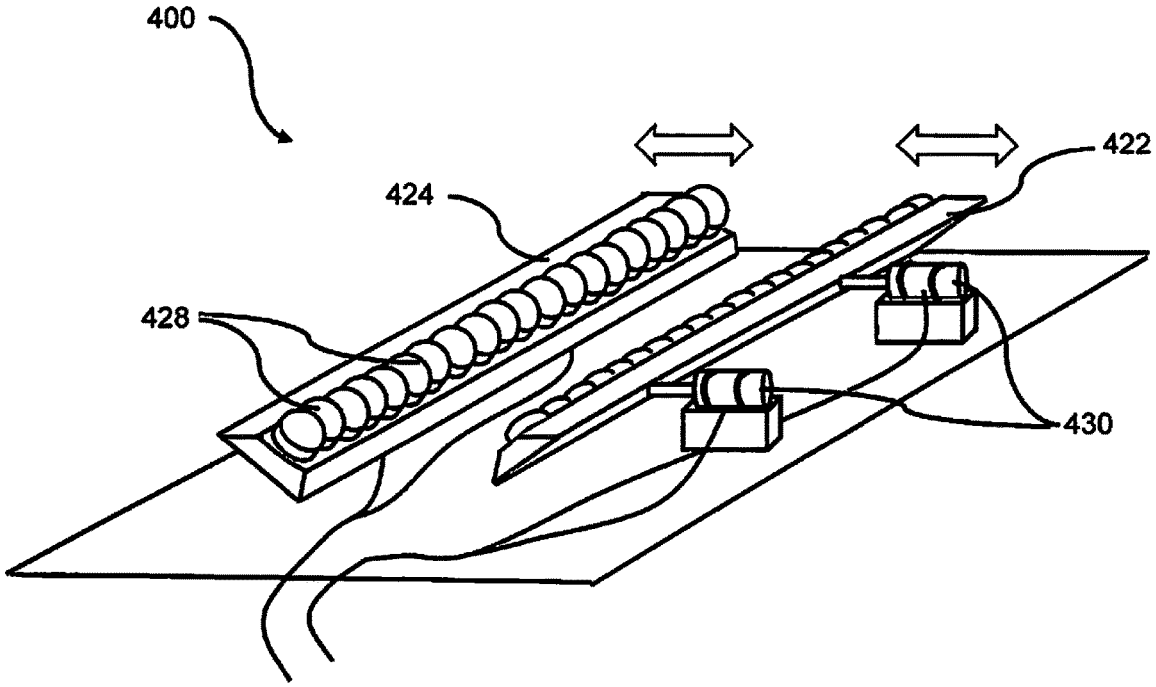

In the embodiment 400 shown in FIG. 6, the padded buds 428 are mounted on two parallel supports 422, 424 which are individually actuated by two hydraulic pistons 430 attached to each support. The hydraulic pistons 430 are arranged to move the supports 422, 424 horizontally in order to impart the desired movement to the vertebral column. This embodiment 400 allows that the massage can be applied without physical requirements to any therapist and therefore the forces can be applied over prolonged periods of time without causing exhaustion to the therapist.

Figure 7:
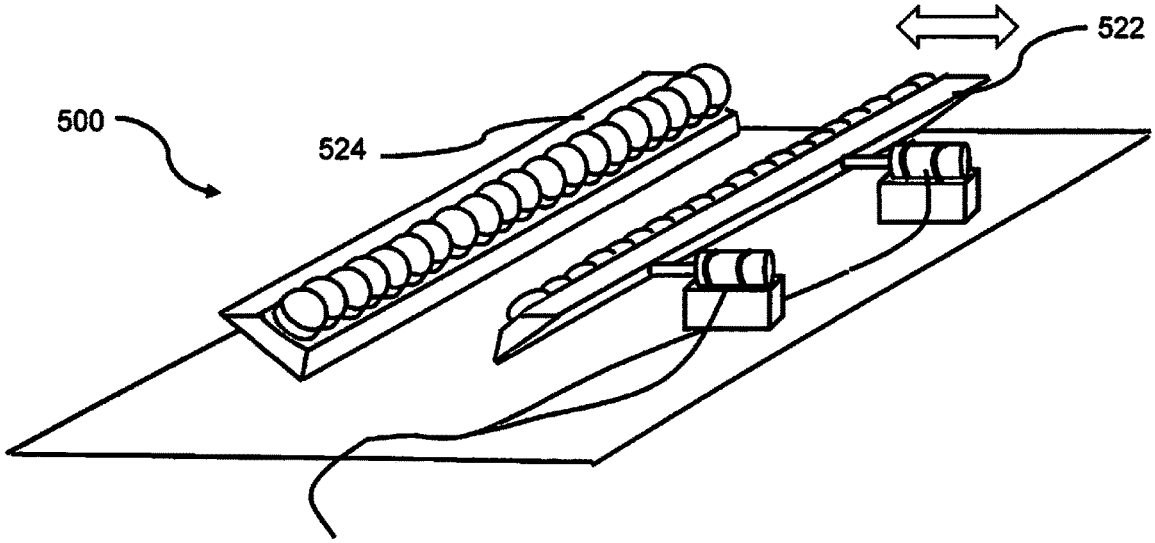

The embodiment 500 shown in FIG. 7 is similar to the one shown in FIG. 6 with the only difference being that in the apparatus 500 of FIG. 7, only one support 522 is actuated hydraulically. The other support 524 is fixed and only acts as a support to resist the forces applied by the movable support 522 and to hold the person receiving the massage in position. In this embodiment, the person receiving the massage must move 180 degrees horizontally in order to receive the forces of the movable support 522 to the opposite side of the column.

Figure 8A:
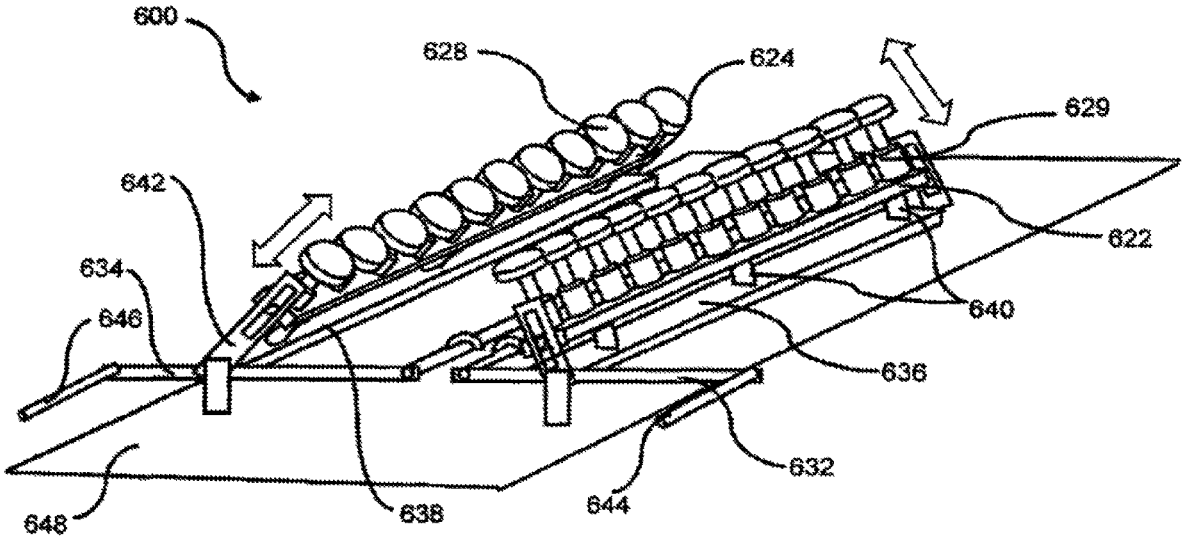

FIG. 8A shows another embodiment 600 of the present invention. This embodiment 600 comprises a fulcrum mechanism to reduce the force applied manually in order to produce the benefits of the massage method described above. The apparatus 600 comprises two supports 622, 624 onto which two parallel pluralities of fingers 629 are mounted. The fingers 629 each comprises a bud 628, which provides a "fingertip" on each finger. In the illustrated example, the buds 628 are dampened by springs (not visible)

located inside the fingers 629. The supports 622, 624 are actuated by levers 632, 634 through other supports 636, 638 and elastomeric connectors 640. The elastomeric connectors 640 allow the required flexibility to couple the movement of the levers 632, 634 to the movement of the fingers 629 which is forced by guides 642 along a desired path.

The forces are applied manually to the handles 644, 646 which are connected to the levers 632, 634. In this way, manual operation allows a better control of the forces and movements applied to the back of the person. The frequency and the sequence of movements are also applied as desired by manual operation.

The whole apparatus 600 is mounted on a base 648 that provides stability and support to the person.

Figure 8B:
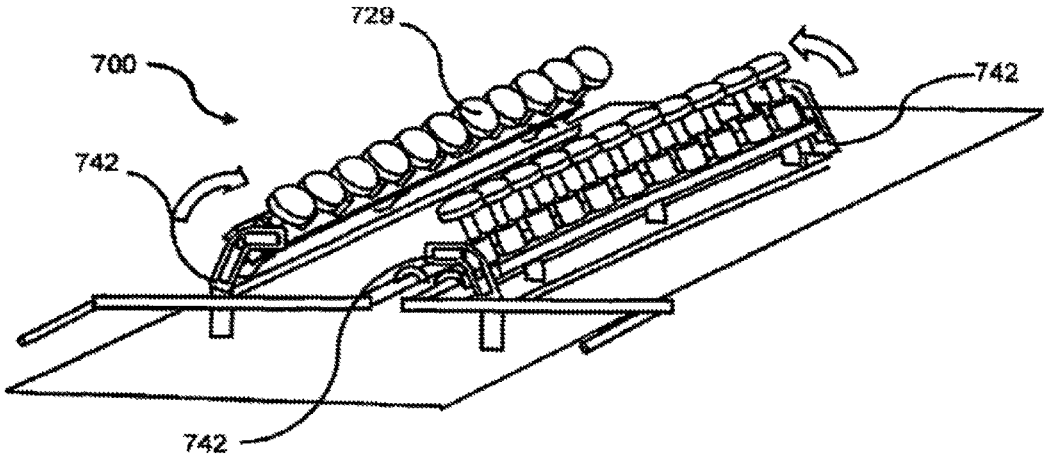

FIG. 8B shows another embodiment 700 of the present invention. This embodiment is very similar to the apparatus shown in FIG. 8A with the only difference being the patch imposed by the guides 742 to the fingers 729. In this embodiment, the movement (indicated by arrows) of the fingers 742 follows an initial substantially vertical movement to engage the area between the spinous and transverse processes of the vertebral column and subsequently the path is substantially horizontal, to create translational horizontal movement of the fingers, such that the vertebral column is moved sideways or rotated.

Figure 8C:
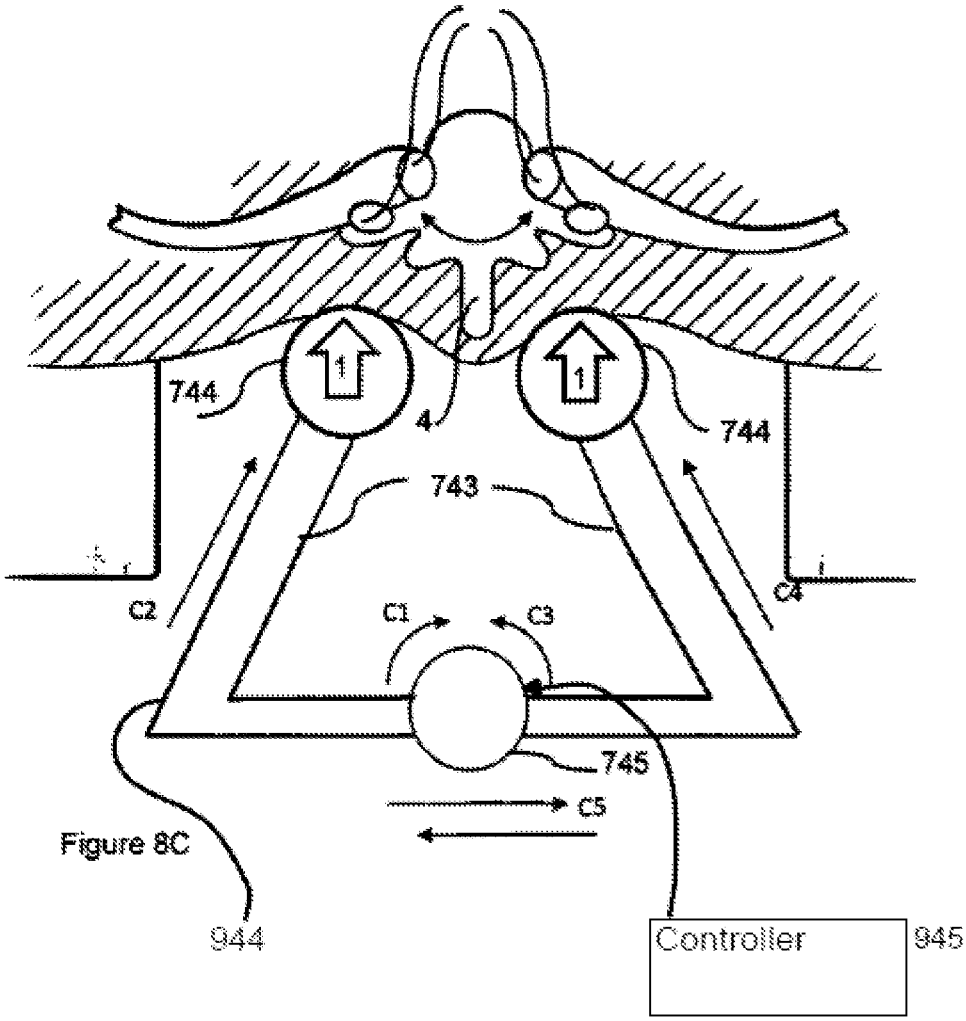

FIG. 8C shows another embodiment of the present invention. This embodiment is shown as an end view of the apparatus included as part of the massage table 800 illustrated in FIG. 9.

In FIG. 8C two manipulating elements or fingers 743 are visible. In the illustrated example the fingers 743 are shown in a massage-ready position with one engagement member or "fingertip" 744 being located to the right of the spine and a second "fingertip" being located to the left of the spine. In the illustrated example, the action of the fingers 743 is controlled by a motor 745.

In the illustrated example a single motor 745 is operable to control the motion of each finger 743 such that the movement of the fingers in the direction C2 and C4 is alternated to create the required pressure and manipulation of the vertebral area between the spinous and transverse processes.

The motor 745 may be configured to rotate as indicated by arrows C1 and C3 wherein rotation of the motor 745 in a counter clockwise direction C1 causes movement of the left-hand finger 744 in the direction C2 towards the spine. Rotation of the motor in a clockwise direction C3 causes movement of the right-hand finger in the direction C4 towards the spine to apply pressure and to manipulate the vertebral area between the spinous and transverse processes as described above and as described further below with reference to FIG. 9.

The motor 745 facilitates movement of the fingers 743 and fingertips 744 to apply pressure and to manipulate the vertebral area between the spinous and transverse processes. The motion of the motor may be rotational as indicated by arrows C1 and C3 as described above or translational as indicated by arrows C5 in FIG. 8C.

The "fingertips" 744 and/or the fingers 743 may include load/position sensors (not illustrated), which are operable to sense load and/or position of the soft tissue in the vertebral area between the spinous and transverse processes. The sensed data can be collated such that a measure of change in stiffness and spinal curvature of the patient's spine, during each therapy session or over a number of therapy sessions, can be monitored and displayed.

The illustrated example (see FIG. 8C) shows a single finger/fingertip 743, 744 located on each side of the vertebral column, but it should be appreciated that a plurality of fingers/fingertips may be included on each side of the vertebral column.

Figure 9:
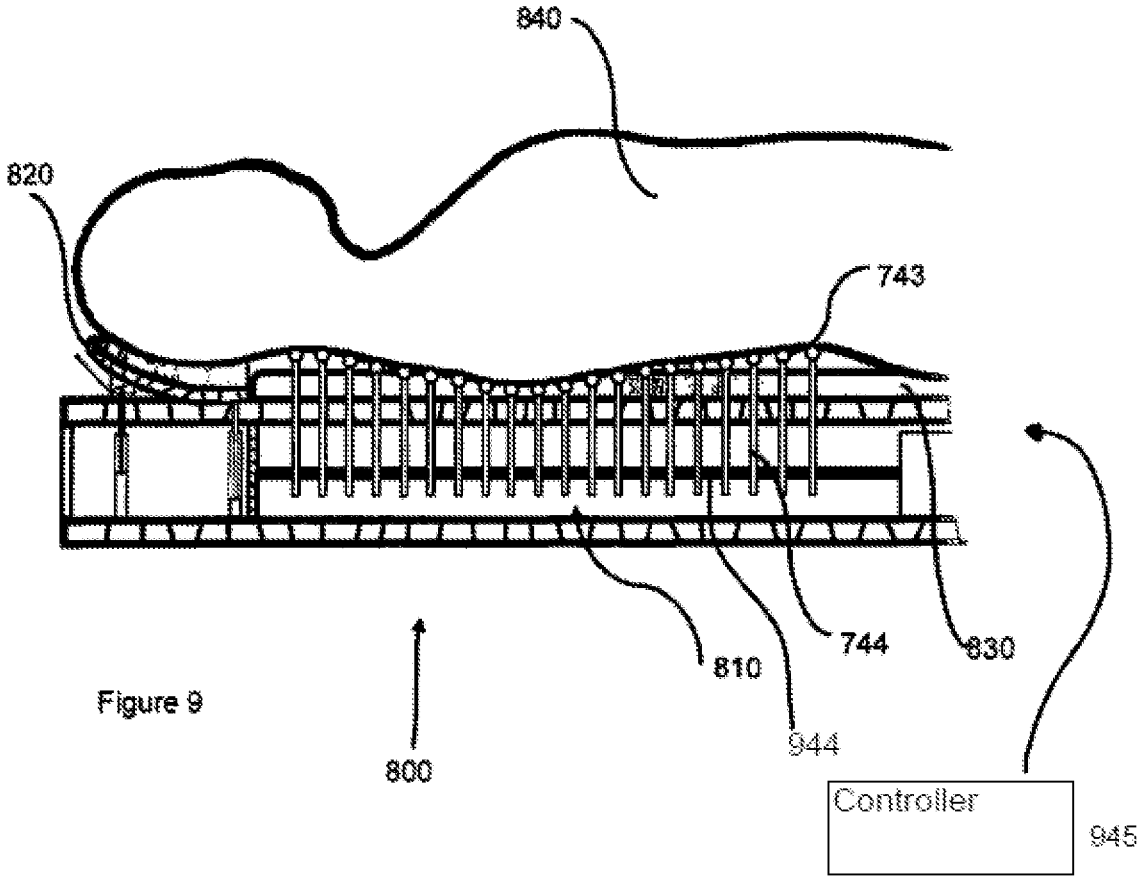
FIG. 9 illustrates a massage table incorporating an embodiment of the present invention.

FIG. 9 illustrates how some of the previously described embodiments, in particular the massage apparatus illustrated in FIG. 8C, can be incorporated into a massage table 800. The massage table 800 comprises a massage apparatus 810 according to an embodiment of the present invention. The massage table also comprises a head rest 820 and a lumbar support 830, so that the person 840 can be comfortably supported while receiving the massage to their back. The massage table 800 can also include dorsal supports (not illustrated) to support the dorsal back areas distant to the vertebral column. The massage table 800 incorporating the apparatus as described above provides a controlled and substantially automated method of massaging the spinal area or vertebral column of a patient's back.

As can be seen in FIG. 9 the patient lies in the supine position with his/her back resting on the table 800. In the illustrated example, it is clear that in this position the patient's back is in contact with the fingers 744 protruding from the massage apparatus 810. Each finger 744 includes an initial resilience to take up the shape and form of the patient's spine before treatment begins. The treatment involves displacing one or more of the fingers on one side of the spine to generate localised displacement and/or rotation of the spine and alternating with displacement of the fingers on the other side.

The massage method comprises simultaneous displacement of one or more of the fingers 744 on one side of the vertebral column to apply pressure via the "fingertips" 743 to a band of soft tissue located to the side of the vertebral column; this action manipulates the area of the vertebral column to improve/restore mobility. The fingers may have integrated sensing elements 944 for sensing the force on the fingers. The actuator operates under the control of a controller 945.

As can be seen from FIG. 9 it is possible, in one action, to apply pressure along the whole length of the vertebral column. Alternatively, it is possible to apply pressure to one side at one end simultaneously with pressure being applied to the opposite side and opposite end of the vertebral column. This may be achieved under the control of a controller 945 which may sense the force on the fingers with integrated sensors 944.

The fingers 744 are displaced to apply pressure/force in a localised area via the fingertips 743. However, by controlling and/or automating the procedure using a controller 945 as illustrated and described above it is possible to apply pressure at multiple locations simultaneously or in one location at a time sequentially along the length of the vertebral column.

Movement of each finger 744 causes displacement of the soft tissue, in the vertebral area between the spinous and transverse processes, adjacent to the vertebral column. As such, the displacement or resistance to displacement may be indicative of the mobility extent of a patient's spine. Therefore, it is anticipated that the apparatus as described above could also be used as a diagnostic tool to diagnose back problems.

A manual massage therapy session in the vertebral area generally lasts around 30 minutes. It will be appreciated that in the same time an apparatus as illustrated in FIG. 9 can deliver multiple pressure points simultaneously and sequentially more rapidly than a manual process. Therefore, the benefit of the apparatus compared with the conventional process is considered to be significant. A massage therapy session using the apparatus for 30 minutes is considered comparable with a four to six manual massage sessions. As such improved mobility of the spine will be evident much sooner when the massage is applied by an apparatus as described above compared with a manual process.

Dimensions, materials of construction and mechanisms may differ in various embodiments of the invention without departing from its principles.

The invention claimed is:

1. Back therapy apparatus operable to apply vertebral massage to a person's back, the apparatus comprising:

a support frame;

a plurality of first manipulating elements movably mounted with respect to the support frame and each one of the plurality of first manipulating elements having a respective first engagement member thereon;

a plurality of second manipulating elements movably mounted with respect to the support frame and each one of the plurality of second manipulating elements having a respective second engagement member thereon;

a controller operable to control actuators coupled to the first and second manipulating elements to effect individual displacement of the first manipulating elements independent of the second manipulating elements with respect to the support frame, wherein the first and second engagement members are each moveable from a direction substantially perpendicular to the person's back to a direction that is substantially parallel to the person's back by a respective first and second guide;

wherein the first and second engagement members are arranged such that, in use, they are arranged and distributed along the length of the vertebral column, wherein the first engagement members are situated on one side of the vertebral column and the second engagement members are situated on an opposite side of the vertebral column wherein the first and second manipulating elements are arranged in pairs, wherein each first manipulating element is associated with a corresponding second manipulating element;

wherein each first engagement member is operable to contact and manipulate a first vertebral area between spinous and transverse processes from one side of the vertebral column and each second engagement member is operable to contact and manipulate a second vertebral area between spinous and transverse processes from the opposite side of the vertebral column, wherein the first manipulating elements facilitate movement of one or more of the first engagement members into and out of contact with the vertebral area between the spinous and transverse processes separate from movement of a corresponding adjacent one or more of the second engagement members thereby manipulating displacement of the vertebral column, wherein the controller is operable to control amplitude of displacement of the first and second engagement members and wherein the controller is operable to control each of the first and second manipulating elements individually or in banks of two or more wherein the controller is operable to control and/or program a sequence of movements of the first and second manipulating elements, to create movement of the spine towards both sides, by controlling the first and second engagement members to at least partially engage the area of the spine between the spinous and transverse processes, by applying force towards the base of the area from each one of their sides and then create a first movement by applying forces towards one side first and then towards the opposite side, to compensate the first movement, wherein the apparatus is adaptable to shapes and contours of a person's vertebral anatomy and arranged to apply a force simultaneously along the length of the spine thereby to provide therapy along the full length of the spine.

2. A back-therapy apparatus according to claim 1, wherein the first and second manipulating elements are each operable to facilitate movement of the first and second engagement members from the direction substantially perpendicular to the person's back to the direction that is substantially parallel to the person's back and from the direction that is substantially parallel to the person's back to the direction that is substantially perpendicular to a person's back.

3. A back-therapy apparatus according to claim 1, wherein the first and second manipulating elements are each operable to facilitate movement of the engagement members into and out of contact with the vertebral area between the spinous processes and the transverse processes at an angle between perpendicular and parallel to the person's back, wherein pressure is applied in a direction towards the opposite side of the person's vertebral column from the side at which the respective engagement member is located.

4. A back-therapy apparatus according to claim 1, wherein the first and second manipulating elements comprise a sensing element operable to sense load and/or displacement of the first and second engagement members when in contact with the vertebral area between the spinous and transverse processes; and being operable to provide feedback of said displacement and/or force as an indication of vertebral stiffness or pain.

5. A back-therapy apparatus according to claim 1, wherein the first and second manipulating elements are operable to adjust the first and second engagement members' orientation respectively, such that the apparatus is adaptable to shapes and contours of a person's vertebral anatomy.

6. A back-therapy apparatus according to claim 1, wherein the position of the first and second engagement members relative to adjacent and corresponding first and second engagement members and relative to the vertebral area between the spinous and transverse processes is adjustable responsively in contact with the vertebral area between the spinous and transverse processes.

7. A back-therapy apparatus according to claim 1, wherein the first and second manipulating elements comprise jointed members.

8. A back-therapy apparatus according to claim 1, wherein the first and second engagement members comprise a resilient contact surface.

9. A back-therapy apparatus according to claim 1, wherein the first and second manipulating elements comprise shape memory material.

10. A back-therapy apparatus according to claim 1, wherein the first and second engagement members comprise shape memory material.

11. A back-therapy apparatus according to claim 10, wherein the controller is operable to automate movement of each of the first and second manipulating elements relative to each other and, in use, relative to vertebral area between the spinous and transverse processes on a person's back optionally wherein the controller is operable to control frequency of movement of each of the first and second manipulating elements.

12. A back-therapy apparatus according to claim 1, wherein the controller is operable to sense or measure displacement from each of the first and second manipulating elements and/or first and second engagement members thereby being operable to identify stiffness in a person's vertebral column.

13. A back-therapy apparatus according to claim 1, wherein the first and second manipulating elements emulate fingers and the first and second engagement members emulate fingertips.

14. A massage table incorporating the back-therapy apparatus comprising:

a support frame;

a plurality of first manipulating elements movably mounted with respect to the support frame and each one of the plurality of first manipulating elements having a respective first engagement member thereon;

a plurality of second manipulating elements movably mounted with respect to the support frame and each one of the plurality of second manipulating elements having a respective second engagement member thereon;

a controller operable to control actuators coupled to the first and second manipulating elements to effect individual displacement of the first manipulating elements independent of the second manipulating elements with respect to the support frame, wherein the first and second engagement members are each moveable from a direction substantially perpendicular to the person's back to a direction that is substantially parallel to the person's back by a respective first and second guide;

wherein the first and second engagement members are arranged such that, in use, they are arranged and distributed along the length of the vertebral column, wherein the first engagement members are situated on one side of the vertebral column and the second engagement members are situated on an opposite side of the vertebral column wherein the first and second manipulating elements are arranged in pairs, wherein each first manipulating element is associated with a corresponding second manipulating element; wherein each first engagement member is operable to contact and manipulate a first vertebral area between spinous and transverse processes from one side of the vertebral column and each second engagement member is operable to contact and manipulate a second vertebral area between spinous and transverse processes from the opposite side of the vertebral column, wherein the first manipulating elements facilitate movement of one or more of the first engagement members into and out of contact with the vertebral area between the spinous and transverse processes separate from movement of a corresponding adjacent one or more of the second engagement members thereby manipulating displacement of the vertebral column, wherein the controller is operable to control amplitude of displacement of the first and second engagement members and wherein the controller is operable to control each of the first and second manipulating elements individually or in banks of two or more wherein the controller is operable to control and/or program a sequence of movements of the first and second manipulating elements, to create movement of the spine towards both sides, by controlling the engagement members to at least partially engage the area of the spine between the spinous and transverse processes, by applying force towards the base of the area from each one of their sides and then create a first movement by applying forces towards one side first and then towards the opposite side, to compensate the first movement, wherein the apparatus is adaptable to shapes and contours of a person's vertebral anatomy and arranged to apply a force simultaneously along the length of the spine thereby to provide therapy along the full length of the spine.

* * * * *